US012522938B2

(12) United States Patent
Liu et al.

(10) Patent No.: US 12,522,938 B2
(45) Date of Patent: Jan. 13, 2026

(54) RARE EARTH-BASED ELECTROLYTIC COLORING METHOD, ELECTROLYTE, AND ALLOY PRODUCT

(71) Applicant: SHENZHEN XIN MAO XIN INDUSTRIAL CO., LTD., Guangdong (CN)

(72) Inventors: Qiuhua Liu, Guangdong (CN); Huailiang Zhang, Guangdong (CN); Hekai Zheng, Guangdong (CN)

(73) Assignee: SHENZHEN XIN MAO XIN INDUSTRIAL CO., LTD., Shenzhen (CN)

( * ) Notice: Subject to any disclaimer, the term of this patent is extended or adjusted under 35 U.S.C. 154(b) by 0 days.

(21) Appl. No.: 19/237,138

(22) Filed: Jun. 13, 2025

(65) Prior Publication Data

US 2025/0333872 A1 Oct. 30, 2025

Related U.S. Application Data

(63) Continuation of application No. PCT/CN2024/131169, filed on Nov. 11, 2024.

(30) Foreign Application Priority Data

Apr. 25, 2024 (CN) ..... 202410507867.X

(51) Int. Cl.
*C25D 11/06* (2006.01)
*C25D 11/14* (2006.01)
(Continued)

(52) U.S. Cl.
CPC ..... *C25D 11/14* (2013.01); *C25D 11/06* (2013.01); *C25D 11/24* (2013.01); *C25D 11/30* (2013.01); *C25D 11/34* (2013.01)

(58) Field of Classification Search
None
See application file for complete search history.

(56) References Cited

U.S. PATENT DOCUMENTS

2011/0048965 A1* 3/2011 Yun ..... C25D 11/30 205/724

FOREIGN PATENT DOCUMENTS

CN 101775633 A 7/2010
CN 102877105 A 1/2013
(Continued)

OTHER PUBLICATIONS

English translation CN 117702221 (Year: 2024).*
Notification to Grant Patent Right for Invention, Chinese Application No. 202410507867.X, mailed May 29, 2024 (3 pages).

*Primary Examiner* — Stefanie S Wittenberg

(57) ABSTRACT

A rare earth-based electrolytic coloring method, electrolyte, and alloy product are provided, where the method includes: after an oxide film is formed on a workpiece subjected to anodic oxidation in the electrolyte, rapidly increasing a voltage, and by using a constant-voltage mode, breaking down, melting, sintering, and reforming the oxide film cyclically multiple times under conditions of high frequency, a high voltage, and instantaneous high temperature, to generate a ceramic film layer metallurgically bonded to a substrate. The oxide film has a greater thickness and lower reflectance, and an appearance as a matte black anode, and has good color consistency and no chromatic aberration. Components of the electrolyte include sodium silicate at a concentration of 5-70 g/L, sodium tungstate at a concentration of 1-18 g/L, disodium ethylenediamine tetraacetic acid at a concentration of 2-10 g/L, and rare earth salts at concentrations of 1-2 g/L.

1 Claim, 4 Drawing Sheets

(51) Int. Cl.

| | |
|---|---|
| ***C25D 11/24*** | (2006.01) |
| ***C25D 11/30*** | (2006.01) |
| ***C25D 11/34*** | (2006.01) |

(56) References Cited

FOREIGN PATENT DOCUMENTS

| | | | |
|---|---|---|---|
| CN | 107740156 | A | 2/2018 |
| CN | 111394771 | A | 7/2020 |
| CN | 112575358 | A | 3/2021 |
| CN | 116926641 | A | 10/2023 |
| JP | 2017106095 | A | 6/2017 |

* cited by examiner

RARE EARTH-BASED ELECTROLYTIC COLORING METHOD, ELECTROLYTE, AND ALLOY PRODUCT

TECHNICAL FIELD

The present invention relates to the field of surface treatment technologies, and specifically, to a rare earth-based electrolytic coloring method, electrolyte, and alloy product.

TECHNICAL BACKGROUND

Electrolytic coloring, also known as plasma electrolytic oxidation, is evolved from anodic oxidation technologies. The electrolytic coloring is a surface treatment technology for electrolytically coloring to-be-processed workpieces through a micro-arc oxidation process, which can endow the workpieces with rich colors and decorative effects. Metal surfaces treated with existing surface treatment processes have defects such as thin oxide films and excessively high reflectance.

SUMMARY

This application provides an electrolytic coloring electrolyte, method, and product for metal and alloy, to increase a thickness of a ceramic film layer on a metal surface and reduce reflectance.

According to a first aspect, this application provides a rare earth-based electrolytic coloring method, including:

- placing a workpiece into an electrolytic tank for anodic oxidation, where a fine and uniform oxide film is formed on a surface of the workpiece after electrification;
- keeping the workpiece in the electrolytic tank continuously for the electrolytic coloring treatment, where after the oxide film is broken down, melted, sintered, and reformed, a ceramic film layer forming a metallurgical bond to a substrate is generated; and during the electrolytic coloring treatment, a voltage is quickly risen to 300V to 440V, and then under a high-frequency constant-voltage mode, a thickness of the ceramic film layer is rapidly increased;
- subjecting the electrolytically colored workpiece to water rinse, where the water rinse is to rinse a sample workpiece with deionized water at room temperature of 25° C.;
- washing, with warm water, the workpiece subjected to water rinse; and
- air-drying and baking the workpiece washed with warm water.

In some embodiments, during the electrolytic coloring treatment, components of the electrolyte include sodium silicate at a concentration of 5-70 g/L, sodium tungstate at a concentration of 1-18 g/L, disodium ethylenediamine tetraacetic acid at a concentration of 2-10 g/L, and rare earth salts at concentrations of 1-2 g/L.

In some embodiments, the rare earth salts include a mixture of one or more of cerium nitrate, lanthanum nitrate, and dysprosium nitrate and one or more of yttrium nitrate, erbium nitrate, and thulium nitrate.

In some embodiments, voltage frequency is 50-100 kHz.

According to a second aspect, this application provides a rare earth-based electrolytic coloring electrolyte with the following component ratio: 5-70 g/L sodium silicate, 3-30 g/L potassium hydroxide, 3-18 g/L potassium fluoride, 5-25 g/L sodium fluoride, 1-18 g/L sodium tungstate, 5-25 g/L ammonium metavanadate, 2-10 g/L disodium ethylenediamine tetraacetic acid, 1-9 g/L triethanolamine, 1-18 g/L potassium ferrocyanide, 3-13 g/L sodium tetraborate, 5-15 g/L glycerol, 2-15 g/L sodium carbonate, 3-10 g/L hexamethylenetetramine, and 1-2 g/L rare earth salts.

According to a third aspect, this application provides a rare earth-based electrolytic coloring alloy product, where the product is prepared using the electrolytic coloring method described in the first aspect.

In some embodiments, surface reflectance of the product is less than 5%; and a thickness of a surface oxide film is 15-100 μm.

In some embodiments, surface reflectance of the product for laser light with a wavelength of 1550 nm is 3.62% to 4.98%; and surface reflectance of the product for laser light with a wavelength of 905 nm is 1.6% to 2.3%.

In some embodiments, the metal alloy includes magnesium alloy, titanium alloy, or aluminum alloy.

Based on the foregoing embodiments, after the oxide film is formed on the workpiece subjected to anodic oxidation in the electrolyte, the voltage is rapidly increased, under a mode of high frequency and a high constant voltage, the oxide film is broken down, melted, sintered, and reformed cyclically multiple times, and the ceramic film layer forming the metallurgical bond to the substrate is generated. Because sodium silicate, sodium tungstate, disodium ethylenediamine tetraacetic acid, and the rare earth salts are added into the electrolyte, the oxide film has a greater thickness and lower reflectance, and an appearance as a matte black anode, and has good color consistency and no chromatic aberration and also has properties such as corrosion resistance and wear resistance.

DETAILED DESCRIPTION OF EMBODIMENTS

The present invention is further described in detail below by using specific embodiments in conjunction with the accompanying drawings. Herein, associated similar element numbers are used for similar elements in different embodiments. In the following embodiments, many details are described to facilitate better understanding of this application. However, persons skilled in the art may readily understand that some features may be omitted in a different case, or may be replaced with another element, material, and method. In some cases, some operations related to this application are not shown or described in this specification, this is intended to prevent excessive descriptions from dominating a core part of this application, and for persons skilled in the art, it is inessential to describe these related operations in detail, and they can fully understand the related operations based on the descriptions in this specification and general technical knowledge in the art.

Figure 4A:
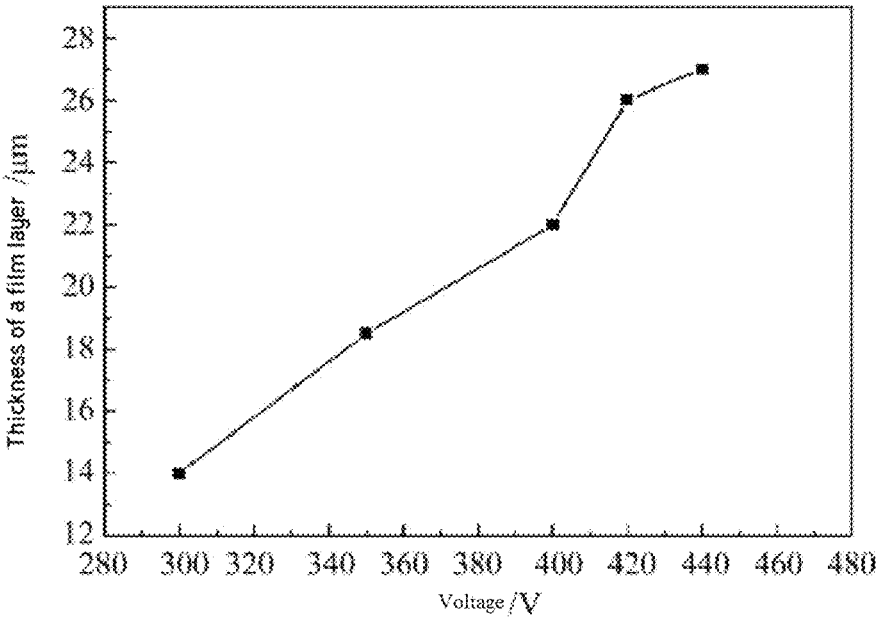
FIG. 4A is a schematic diagram of effects of different voltages on a film thickness under a constant-voltage mode according to an embodiment.
Figure 4B:
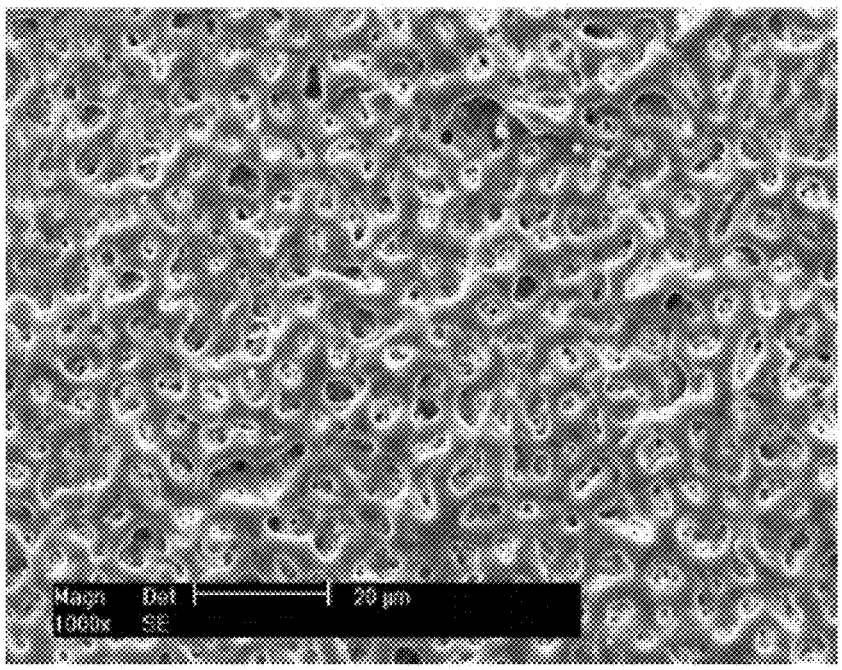
FIG. 4B shows a surface morphology of a film layer under a mode of a 300V constant voltage according to an embodiment.
Figure 4C:
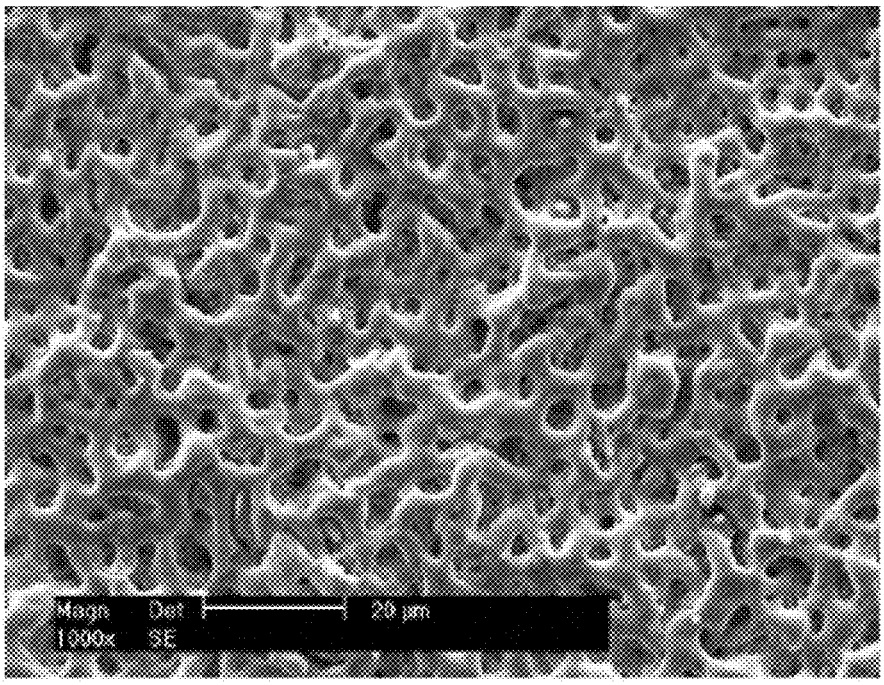
FIG. 4C shows a surface morphology of a film layer under a mode of a 400V constant voltage according to an embodiment.
Figure 4D:
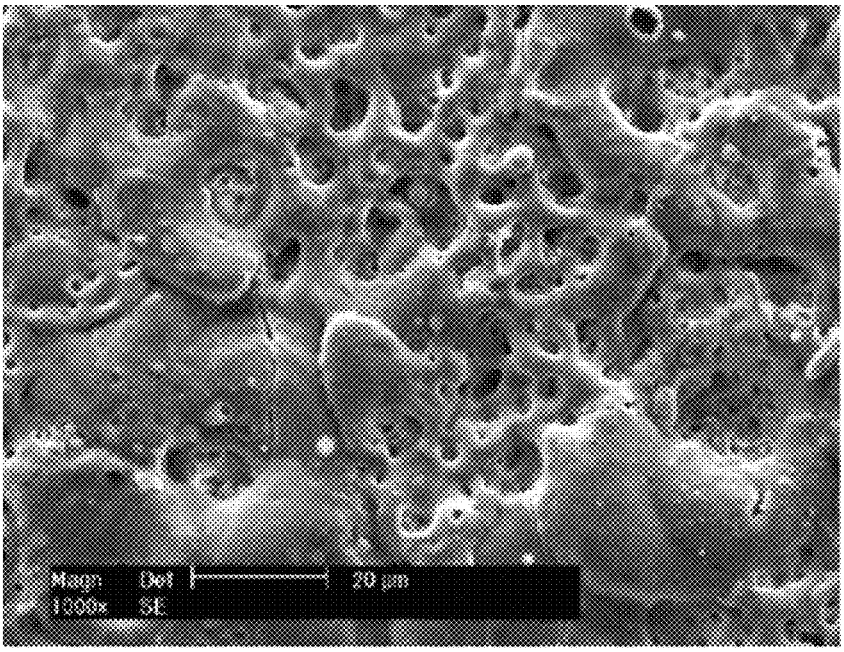
FIG. 4D shows a surface morphology of a film layer under a mode of a 440V constant voltage according to an embodiment.

This application provides an electrolytic coloring method for metal alloy, including:

first, subjecting a workpiece to ultrasonic cleaning; and to be specific, placing a sample workpiece into a container, adding an acetone solution at a mass concentration of over 99%, and performing ultrasonic cleaning in an ultrasonic cleaner;

then placing the workpiece into an electrolytic tank for anodic oxidation, where a fine and uniform oxide film is formed on a surface of the workpiece after electrification;

keeping the workpiece in the electrolytic tank continuously for the electrolytic coloring treatment, where after the oxide film is broken down, melted, sintered, and reformed, a ceramic film layer forming a metallurgical bond to a substrate is generated; and during the electrolytic coloring treatment, a voltage is quickly risen to 300V to 440V, and under a constant-voltage mode, a thickness of the ceramic film layer is rapidly increased (for surface morphologies of film layers under action of different constant voltages, refer to FIG. 4(*b*) to FIG. 4(*d*));

subjecting the electrolytically colored workpiece to water rinse;

washing, with warm water, the workpiece subjected to water rinse; and air-drying and baking the workpiece washed with warm water.

According to a second aspect, this application provides a rare earth-based electrolytic coloring alloy product with the following component ratio: 5-70 g/L sodium silicate, 3-30 g/L potassium hydroxide, 3-18 g/L potassium fluoride, 5-25 g/L sodium fluoride, 1-18 g/L sodium tungstate, 5-25 g/L ammonium metavanadate, 2-10 g/L disodium ethylenediamine tetraacetic acid, 1-9 g/L triethanolamine, 1-18 g/L potassium ferrocyanide, 3-13 g/L sodium tetraborate, 5-15 g/L glycerol, 2-15 g/L sodium carbonate, 3-10 g/L hexamethylenetetramine, and 1-2 g/L rare earth salts. The rare earth salts include a mixture of one or more of cerium nitrate, lanthanum nitrate, and dysprosium nitrate and one or more of yttrium nitrate, neodymium nitrate, and thulium nitrate.

It should be noted that, in general, a high-frequency power supply can increase a growth rate of the oxide film, but the thickness of the film is relatively small, and an excessively high voltage may lead to local breakdown of the oxide film, which is detrimental to the corrosion resistance of the oxide film.

Therefore, sodium silicate is chosen as the main salt for the electrolyte in this application, which helps generate a complete micro-arc oxidation film layer with planar continuity on a substrate surface and can improve a density of the film layer; and the presence of sodium silicate can reduce a corrosion current density of the oxide film layer, thereby significantly improving the corrosion resistance of the film layer. Sodium silicate can increase conductivity of the electrolyte, to reduce a striking voltage on the substrate surface, so that an oxidation process is more efficient and a film formation speed is greater during the electrolytic coloring. In addition, addition of sodium tungstate and disodium ethylenediamine tetraacetic acid to the electrolyte can improve the conductivity and stability of the electrolyte, thereby helping form a uniform and dense oxide film.

In addition, because rare earth elements include both heavy and light rare earths, a new phase is generated on a product surface, and an organizational structure is refined and more uniform and denser, thereby reducing surface reflectance of the product. Lanthanum nitrate ($La(NO_3)_3$) can promote formation of the oxide film, which increases density and hardness of the oxide film; rare earth elements such as cerium (Ce) and yttrium (Y) are added to the electrolyte during the micro-arc oxidation, which can increase the generation rate of the oxide film; and thicknesses of a magnesium alloy micro-arc oxidation film obtained after treatment with a solution of rare earth neodymium (Nd) salt for a short time is uniform.

It can be seen that because components of the electrolyte in this application include sodium silicate at a concentration of 5-70 g/L, sodium tungstate at a concentration of 1-18 g/L, disodium ethylenediamine tetraacetic acid at a concentration of 2-10 g/L, and rare earth salts at concentrations of 1-2 g/L, holes and cracks in the film layer are reduced and the density is improved, thereby reducing the surface reflectance of the product. This fully exerts advantages of rapid film formation via a high-frequency power supply and rapid electrolytic coloring via a high-voltage power supply, and also overcomes disadvantages of relatively thin film formed via the high-frequency power supply and the poor corrosion resistance of the oxide film caused due to an excessively high voltage.

Figure 1:
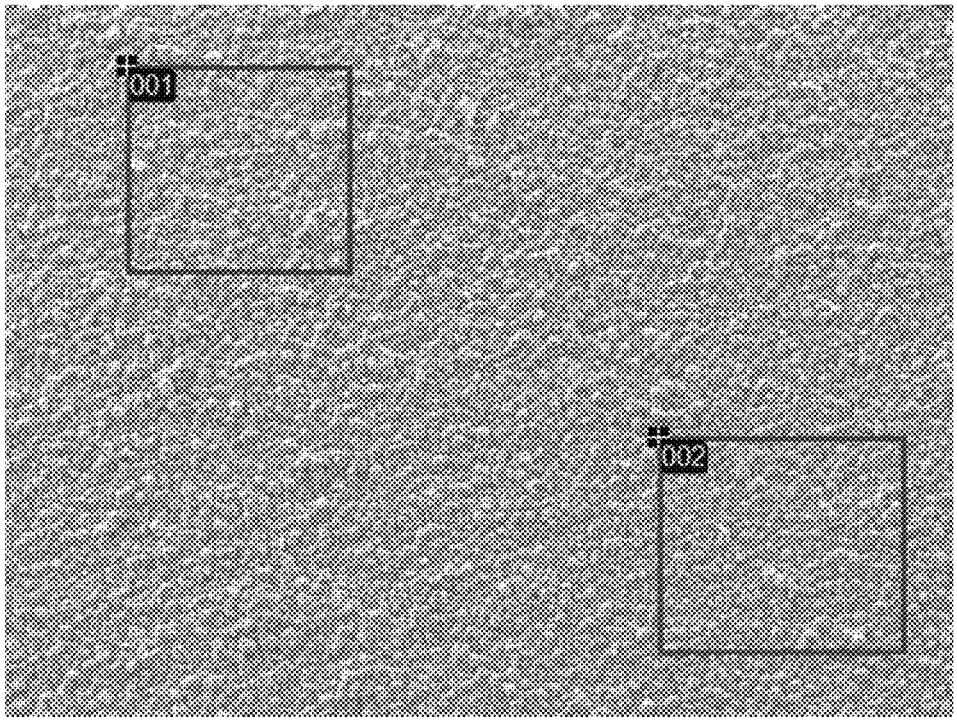
FIG. 1 shows a schematic diagram of a scanning electron microscopy image of a ceramic layer according to an embodiment.
Figure 2:
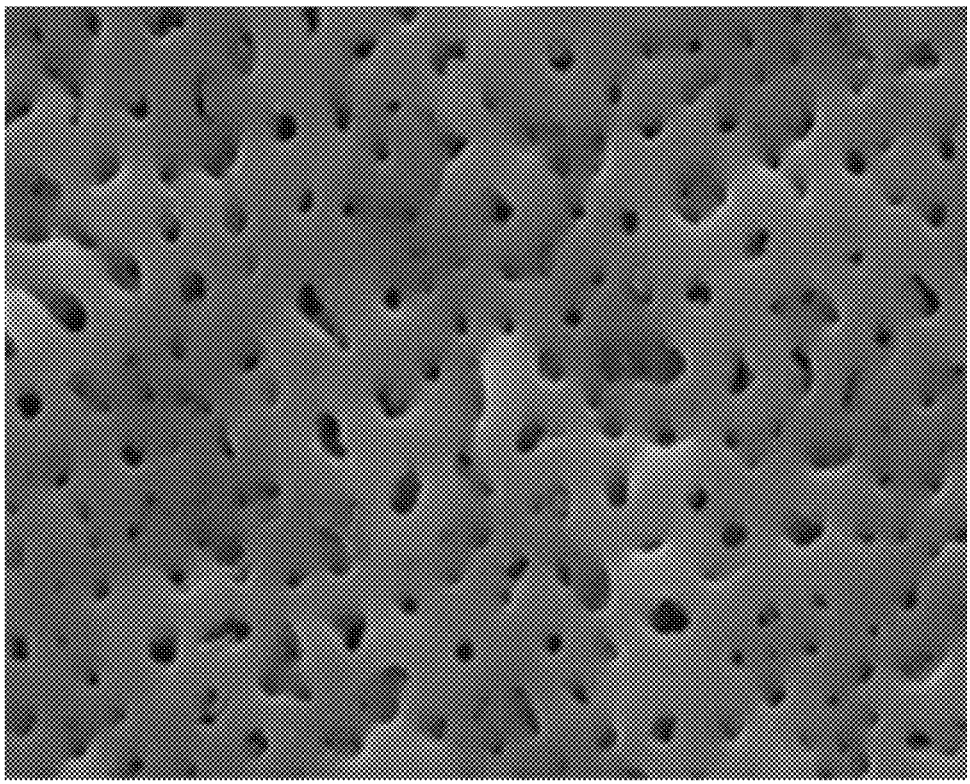
FIG. 2 is a partially enlarged view of FIG. 1.
Figure 3:
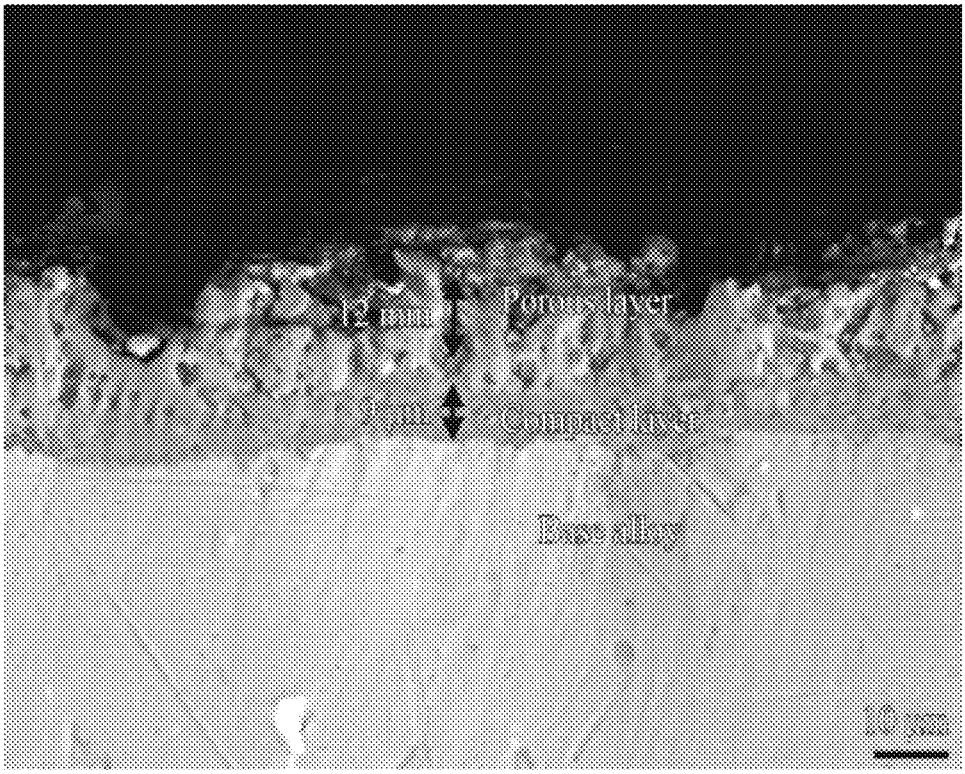
FIG. 3 is a schematic diagram of cross-sectional morphology of a ceramic layer according to an embodiment.

As shown in FIG. 1 to FIG. 3 and FIG. 4(*a*) to FIG. 4(*d*), under a mode of high frequency and a high constant voltage, in this application, a ceramic film layer with significant thickness is rapidly formed. As exemplified in FIG. 3, the obtained layer consists of a 9-μm dense layer and a 12-μm porous layer, achieving a total thickness of 21 μm. This structure results in substantially reduced surface reflectance of the final product.

In this application, under the action of the high-frequency power supply, the oxide film is rapidly formed and continuously thickened, the number of micropores in the oxide film decreases, and diameters of the micropores increase, which causes melting. After melting, the oxide film solidifies into small particles, and the small particles cover some micropores, which further decreases the number of micropores. Under the action of the high-voltage power supply, multiple parts of the oxide film are repeatedly broken down, and the molten oxide is ejected from the micropores to the periphery and accumulated repeatedly. After accumulation, under a quenching effect of the electrolyte, the molten oxides solidify into a hard ceramic layer. In addition, the high-voltage power supply enables colored metal ions in the electrolyte to penetrate into the oxide film, to implement coloration, thereby enhancing depth and durability of the coloration.

According to a third aspect, this application provides a rare earth-based electrolytic coloring alloy product, where the product is prepared using the electrolytic coloring method described in the first aspect.

In some embodiments, surface reflectance of the product is less than 5%; and a thickness of a surface oxide film is 15-100 μm.

In some embodiments, surface reflectance of the product for laser light with a wavelength of 1550 nm is 3.62% to 4.98%; and surface reflectance of the product for laser light with a wavelength of 905 nm is 1.6% to 2.3%.

In some embodiments, the metal alloy includes magnesium alloy, titanium alloy, or aluminum alloy.

A sensing capability of LiDAR is crucial to safety of autonomous driving and low reflectance of the product is vital. In a specific embodiment, in terms of appearance treatment for application to the LiDAR and a vehicle-mounted optical structural component, aluminum alloy is used as an anode, stainless steel is used as a cathode, under action of the electric field in the electrolyte, an oxide film is formed on the workpiece, and under conditions of a high voltage and instantaneous high temperature, the oxide film is broken down, melted, sintered, and reformed cyclically multiple times, to generate a ceramic film layer metallurgically bonded to the substrate. The oxide film is thicker and has lower reflectance. The aluminum alloy includes AL6061 aluminum profile and ADC12, HTCO2, ENAC43500 die-cast aluminum.

Through diffuse reflection testing, the surface reflectance of the product in this application is less than 5%, indicating good performance of low reflectance.

In a specific embodiment, results measured by using R1000 reflectance tester from Yuke Instrument show that surface reflectance of the product for laser light with a wavelength of 1550 nm is 3.62% to 4.98%; and surface reflectance of the product for laser light with a wavelength of 500 nm, 850 nm, or 905 nm is 1.6% to 2.5%.

Compared with other existing surface treatment processes, the oxide film on the surface of the electrolytically colored product in this application has a thickness of 15 to 100 μm, which implements performance such as low reflectance, corrosion resistance, wear resistance, high insulation performance, high hardness, and a low coefficient of friction.

In addition, features, operations, or characteristics described in this specification may be combined into various embodiments in any proper manner. In addition, a sequence of steps or operations in method descriptions may also be switched or adjusted in a manner obvious to persons skilled in the art.

The specific embodiments described above are merely illustrative examples to facilitate understanding of the present invention, and are not intended to limit its scope. Persons skilled in the art may make several simple deductions, modifications, or substitutions based on the inventive concept of the present invention.

What is claimed is:

1. A rare earth-based electrolytic coloring method, applied to magnesium alloy, titanium alloy, or aluminum alloy and comprising:

placing a workpiece into an electrolytic tank for anodic oxidation, wherein a fine and uniform oxide film is formed on a surface of the workpiece after electrification;

keeping the workpiece in the electrolytic tank continuously for an electrolytic coloring treatment, wherein after the oxide film is broken down, melted, sintered, and reformed, a ceramic film layer forming a metallurgical bond to a substrate is generated; and during the electrolytic coloring treatment, a voltage is risen to between 300V to 440V, and then under a high-frequency constant-voltage mode, a thickness of the ceramic film layer is increased, wherein a thickness of a surface oxide film is 15-100 μm and voltage frequency is 50-100 kHz;

subjecting the electrolytically colored workpiece to water rinse;

washing, with warm water, the workpiece subjected to water rinse; and air-drying and baking the workpiece washed with warm water;

wherein a component ratio of an electrolytic coloring electrolyte during the electrolytic coloring treatment is as follows: 5-70 g/L sodium silicate, 3-30 g/L potassium hydroxide, 3-18 g/L potassium fluoride, 5-25 g/L sodium fluoride, 1-18 g/L sodium tungstate, 5-25 g/L ammonium metavanadate, 2-10 g/L disodium ethylenediamine tetraacetic acid, 1-9 g/L triethanolamine, 1-18 g/L potassium ferrocyanide, 3-13 g/L sodium tetraborate, 5-15 g/L glycerol, 2-15 g/L sodium carbonate, 3-10 g/L hexamethylenetetramine, and 1-2 g/L rare earth salts; and the rare earth salts are a mixture of one or more of cerium nitrate, lanthanum nitrate, and dysprosium nitrate and one or more of yttrium nitrate, neodymium nitrate, and thulium nitrate.

* * * * *